US007636979B1

(12) United States Patent
Morad et al.

(10) Patent No.: US 7,636,979 B1
(45) Date of Patent: Dec. 29, 2009

(54) ATTACHMENT MECHANISM TO A METAL MOP HEAD TO SECURELY RETAIN A CLEANING IMPLEMENT ATTACHMENT ON A BUTTERFLY MOP

(75) Inventors: Fred I. Morad, Toluca Lake, CA (US); William P. Camp, Jr., Vanlue, OH (US)

(73) Assignee: Worldwide Integrated Resources, Inc., Commerce, CA (US)

( * ) Notice: Subject to any disclaimer, the term of this patent is extended or adjusted under 35 U.S.C. 154(b) by 868 days.

(21) Appl. No.: 11/190,803

(22) Filed: Jul. 26, 2005

(51) Int. Cl.
*A47L 13/14* (2006.01)

(52) U.S. Cl. ..... 15/116.2; 15/119.2

(58) Field of Classification Search ..... 15/116.1, 15/116.2, 228, 119.1, 119.2, 115
See application file for complete search history.

(56) References Cited

U.S. PATENT DOCUMENTS

| | | | | |
|---|---|---|---|---|
| 1,462,829 | A | 7/1923 | Roberts | |
| 2,637,059 | A * | 5/1953 | Vosbikian et al. | 15/119.2 |
| 2,701,888 | A | 2/1955 | Vosbikian | |
| 2,895,152 | A | 7/1959 | Vosbikian | |
| 2,916,754 | A | 12/1959 | Zottola | |
| 4,604,767 | A | 8/1986 | Burkhart | |
| 4,654,920 | A | 4/1987 | O'Neil | |
| D290,892 | S | 7/1987 | Slany | |
| D295,912 | S | 5/1988 | Jones | |
| 4,748,710 | A * | 6/1988 | Jones | 15/119.2 |
| 5,138,736 | A * | 8/1992 | Pesa | 15/119.2 |
| 5,483,720 | A | 1/1996 | Decoopman | |
| 5,488,750 | A | 2/1996 | Vosbikian | |
| D420,775 | S | 2/2000 | Petner | |
| 6,058,548 | A * | 5/2000 | Footer et al. | 15/119.2 |
| 6,085,378 | A | 7/2000 | Petner | |
| 6,178,581 | B1 | 1/2001 | Lewis | |
| RE37,415 | E | 10/2001 | Petner | |
| 6,336,240 | B1 | 1/2002 | Laux | |
| 6,588,045 | B2 | 7/2003 | Fernandez | |
| 6,698,056 | B1 | 3/2004 | Oretti | |
| 2004/0016072 | A1 | 1/2004 | Libman et al. | |
| 2004/0265037 | A1 * | 12/2004 | Vosbikian et al. | 401/139 |

FOREIGN PATENT DOCUMENTS

| | | |
|---|---|---|
| EP | 1142526 | 11/2000 |
| WO | WO 01/03566 | 1/2001 |

* cited by examiner

*Primary Examiner*—Laura C Guidotti
(74) *Attorney, Agent, or Firm*—Thomas I. Rozsa

(57) ABSTRACT

The present invention is a cleaning implement such as a scrubber brush attachment which permanently holds the scrubber brush attachment in place on a metal butterfly sponge mop head and will not fall off during the vigorous scrubbing action because it is locked in place by means of a novel attaching mechanism. The present invention is comprised of a molded plastic attaching mechanism which has a body having a generally flat plate which at one end is molded to a brush head which receives the scrubbing bristles of the brush. The fixed metal housing of the metal butterfly mop head is modified so that the front and rear of the fixed metal housing of the mop head have mating openings which receive corresponding teeth formed into the plastic attaching mechanism.

11 Claims, 5 Drawing Sheets

ATTACHMENT MECHANISM TO A METAL MOP HEAD TO SECURELY RETAIN A CLEANING IMPLEMENT ATTACHMENT ON A BUTTERFLY MOP

BACKGROUND OF THE INVENTION

1. Field of the Invention

The present invention relates to butterfly mops and more particularly to a butterfly mop having a metal mop head which is provided with a cleaning implement such as a scrubber pad or scrub brush to thereby enable the mop to be used to perform the dual function of washing a floor with a mop in the normal manner, and alternatively to remove soil resistant to removal through washing by applying a scrub brush surface or an abrasive surface to the floor or wall being cleaned.

2. Description of the Prior Art

In general, mops including both butterfly mops and wringer mops with scrubber attachments are known in the prior art. The following twenty patents are relevant to the field of the present invention.

1. U.S. Pat. No. 1,462,829 issued to Roberts on Jul. 24, 1923 for "Scraper Attachment For Brooms" (hereafter the "Roberts Patent");

2. U.S. Pat. No. 2,701,888 issued to Vosbikian on Feb. 15, 1955 for "Detachable Bracket For Mops With Cleaning Material" (hereafter the "'888 Vosbikian Patent");

3. U.S. Pat. No. 2,895,152 issued to Vosbikian on Jul. 21, 1959 for "Mops With Replaceable Mop Heads And Extractor Mechanism" (hereafter the "'152 Vosbikian Patent");

4. U.S. Pat. No. 2,916,754 Issued to Zottola on Dec. 15, 1959 for "Mop With Cam Wringer" (hereafter the "Zottola Patent");

5. U.S. Pat. No. 4,604,767 issued to Burkhart on Aug. 12, 1986 for "Wringer Mop" (hereafter the "Burkhart Patent");

6. U.S. Pat. No. 4,654,920 issued to O'Neil on Apr. 7, 1987 for "Sponge Mop With Scrubber Attachment" (hereafter the "O'Neil Patent");

7. U.S. Pat. No. Des. 295,912 issued to Jones on May 24, 1988 for "Wringer Mop Head With Scrubber" (hereafter the "Jones Patent");

8. U.S. Pat. No. 5,483,720 issued to Decoopman on Jan. 16, 1996 for "Sponge Mop" (hereafter the "Decoopman Patent");

9. U.S. Pat. No. 5,488,750 issued to Vosbikian on Feb. 6, 1996 for "Sponge Mop Attachment" (hereafter the "'750 Vosbikian Patent");

10. U.S. Pat. No. Des. 420,775 issued to Petner on Feb. 15, 2000 for "Butterfly Sponge Mop With Integral Molded Head" (hereafter the "'775 Petner Patent");

11. U.S. Pat. No. 6,085,378 issued to Petner on Jul. 11, 2000 for "Self-Wringing Swab Mop With Scrubber" (hereafter the "'378 Petner Patent");

12. U.S. Pat. No. 6,178,581 B1 issued to Lewis on Jan. 30, 2001 for "Mop Scrubber Adapter" (hereafter the "Lewis Patent");

13. U.S. Reissued Pat. No. US RE37,415 E issued to Petner on Oct. 23, 2001 for "Cam Actuated Roller Mop With Scrubber Attachment" (hereafter the "Reissue Petner Patent");

14. U.S. Pat. No. 6,336,240 B1 issued to Laux on Jan. 8, 2002 for "Modular Sponge Mop" (hereafter the "Laux Patent");

15. U.S. Pat. No. 6,588,045 B2 issued to Fernandez on Jul. 8, 2003 for "Roller Self-Wringing Sponge Mop With Scrubber" (hereafter the "Fernandez Patent");

16. United States Patent Application Publication No. US 2004/0016072 A1 to Libman on Jan. 29, 2004 for "Wringer Mop With Removable Mop Head" (hereafter the "Libman Patent");

17. U.S. Pat. No. 6,698,056 B1 issued to Oretti on Mar. 2, 2004 for "Butterfly Sponge Mop With Angle-Adjustable Handle" (hereafter the "Oretti Patent");

18. EP Application No. EP 1 142 526 A1 filed on Nov. 30, 2000 for "Wringer Mop With Removable Mop Head";

19. U.S. Pat. Des. 290,892 issued on Jul. 14, 1987 to Slany for "Combined Floor Scrubber And Mop" (hereafter the "Slany Patent");

20. WIPO Patent WO 0/03566 A1 to Petner and assigned to Quickie Manufacturing Corporation (hereafter "Patent WO-01/03566 A1).

The Roberts Patent which issued in 1923 is a scraper attachment for brooms. Specifically focusing on FIG. 1 and on the second column on the first page beginning on Line 64 it states "Bar 6 on both of the edges of its angles is provided with a plurality of apertured lugs or ears 9, by means of which the bar may be securely fastened to the brush block." This is just simply fastening the scraper by three screws to the head of the broom.

The '888 Vosbikian Patent which issued in 1955 is a detachable bracket for mops with cleaning material. This is simply a rectangular bracket for holding bristle broom brushes and contains a screw mechanism by which it is attached to the sponge mop portion.

The '152 Vosbikian Patent which issued in 1959 is dealing with mops with replaceable mop heads and an extractor mechanism. This essentially involves attachment of a brush to a sponge mop and consists of a metal bracket with bolts through it which are fastened by wing nuts.

The Zottola Patent deals with a mop with a cam wringer and also has a method of attaching a brush to the cam wringing portion of the mop. Specifically, the focus of this invention deals with plate 60 which carries brush 22. Plate 60 is secured to plate 41 which has the cam action wringer for the sponge mop through means of bolts passing through the brush 22, plate 60 and plate 41 held in position by knurled nuts 69 and 70.

The Burkhart Patent discloses a wringer sponge mop and scrubber attachment, the scrubber attachment carrying a detachable scrubber pad. Referring to Column 2 beginning on Line 46, the patent states "The scrubber attachment 40 in the embodiment illustrated at FIGS. 1 to 4 is defined by rigid bent wire 46, either integral or of several wire pieces welded together, such that the end portions of the scrubber attachment 40 define a U-portions 47 over which the channel member 42 may be slid. Each one of a pair of arm members extending from U-loop portions 47 includes a loop 48, to thereby define an apertured ear, each loop 48 terminating in an extending arm portion 50. The portions 46, 48, and 50 define a rigid frame member . . . . As illustrated in FIG. 4, the pad carrying channel member 42 is slidable on and off of wire frame 45." With respect to the second embodiment most notably illustrated in FIG. 7, the scrubber attachment 100 includes a horizontal run 102 of stiff wire. The numeral 120 denotes a stiff, sheet metal base having a central, longitudinal running channel 122 and longitudinally running overhanging flanges 124 to provide stiffness to the base. Therefore, the wire is slid into this base for purposes of attaching the scrubber.

The O'Neil, Jr. Patent deals with a sponge mop with a scrubber attachment. It includes a scrubber attachment fixedly mounted to a wringer type sponge mop without the necessity for any extra attaching hardware. The scrubber attachment carries a scrubber pad that is secured to the mop head at a predetermined angle. The attachment is best illustrated in FIG. 4 wherein the attachment 40 consists of a plastic plate or sheet. It also includes a pair of ears 46 having a central aperture through which the axles of the sponge mop protrude as illustrated in the cross-sectional views of FIGS. 2 and 3.

The Jones Patent discloses a design patent for a wringer mop head with a scrubber.

The Decoopman Patent deals with a sponge mop. The device includes a scraper as illustrated in FIGS. 13 and 14. The scraper includes a pad 47 secured to the support plate which in turn is fit into a cylindrical member by means of the portion they called finger 49. Referring to Column 10, line 59, the patent states "In order to avoid any untimely disconnection of the pad 47 from the support plate 48, the rail 58 projecting from the front face of said support plate 48 advantageously has a first abutment face 60 situated at one end and a first portion 61 of a snap-fastening system situated near its opposite end. The groove 59 in the rear face of the backing plat 57 then has a second abutment face 62 situated at one end and a second portion 63 of the same snap-fastening system situated towards its opposite. The pad is mounted on the support plate 48 by causing the groove 59 to slide on the projecting rail 58. The sliding is continued until the first second abutment faces 60 and 62 and also the first and second portions of the snap-fastening system 61, 63 co-operate mutually so as to hold the pad locked in position."

The '750 Vosbikian Patent deals with a sponge mop attachment. The device which holds the scrubber is best illustrated in FIGS. 3 through 9 and includes two detent tabs 14 and 15 which fit into cutouts in the mops 10 and 11. Also, there are openings 19 and 18 to receive a front tip of the squeeze arms 6 and 7.

The '775 Petner Patent appears to have the same structural features of the previous Vosbikian Patent with respect to the attachment of the scrubber, although it does not have the front housing to which the scrubber is attached as in the Vosbikian Patent.

The '378 Petner Patent discloses a self-wringing swap mop with a scrubber. Referring to Column 3, line 24, it states "Attached to flat outer surface 24 is an abrasive scrubber member 26. It will be appreciated the scrubber member 26 can be an abrasive pad, brush or similar course surface which can be permanently attached to the outer surface 24 or attached by means of Velcro."

The Lewis Patent is a mop scrubber adapter. Referring particularly to Column 3, line 32, the patent states "As best shown in FIG. 3, the scrubber adapter 10 has detent tabs 40 which fit the sides and front of the head attachment 16. Two arms 44 extend rearwardly from the scrubber adapter 10, each arm having a side detent tab 40 at an end thereof. In the illustrated embodiment, the side detent tabs 40 are sized for insertion into a notch 48 of the head attachment 16. A front detent tab 50 extends rearwardly from the adapter 10 and is sized to extend from a lower rear edge 52 of the head attachment 16."

The Reissue Petner Patent is a cam actuated roller mop with a scrubber attachment. The mop is combined with an integral mop attachment with an outer abrasive surface, designed and formed to be positioned within a wall surface. The attachment is removable and interchangeable for use on similarly configured roller mops. Referring to Column 4, line 60, the patent states "Frame 14 further preferably supports a removable floor scrubbing mop attachment 20 which has a planar abrasive scrubbing surface 24 as illustrated best in FIGS. 1 and 11." Referring to Column 5, line 18, the patent further states "As seen FIG. 11, removable mop attachment 20 includes a planar support panel 74 and is maintained in position in tunnel housing 42 of frame 14 by side support guides 76 and a central support stop 78, all of which are preferably integrally molded with mop attachment 20 as a single piece of plastic."

The Laux Patent relates to a modular sponge mop. The sponge mop is retained on a backing plate. Referring to Column 3 beginning on line 55, it states "As may best be seen in FIGS. 2 and 8, the backing plate 52 further includes a pair of spaced legs 70, 72 located adjacent opposing lateral sides of the backing plate 52. The legs 70, 72 are adapted to slide through corresponding slots 74, 76 extending into the front edge 18 from the lower side thereof. In addition, each of the legs 70, 72 includes a respective tang portion 78, 80 extending perpendicularly thereto. The tang portions 78, 80 engage a back surface 82 (FIG. 3) of the front edge 18 whereby the backing plate 52 is held in contact with the front edge 18 as it is inserted upwardly to engage the legs 70, 72 within the slots 74, 76."

The Fernandez Patent is a roller self-wringing sponge mop with a scrubber. The scrubber designated as 42 is provided on the narrow end of the mop head 14. The scrubber/scraper 42 includes a scrubbing material 42a and scraper edge 42b. The scrubber/scraper 42 is attached to the mop head 14 in a removable manner such as by projections that slide within undercuts on the end of the mop head 14 and are held tightly by an interference fit.

The Libman Patent Application is a published application which was published on Jan. 29, 2004. This patent application discloses a slot arrangement for retaining a working brush. Referring to Section 46 of the application, it states "For further convenience, the working end 24 of the mop can be provided with a removable brush 92. The brush illustrated in FIG. 22 has a slotted resilient web 93 that fits within a sleeve 95 on the working end of the mop (FIG. 21). The web comprises a depression 97 that engages an internal knob 99 in the sleeve to hold the brush in place."

The European Patent Application is in effect the European publication of the Libman Patent is disclosed above. This is the reason that the application was published. It effectively discloses the same thing as just discussed in the U.S. Libman patent publication.

The Oretti Patent is a butterfly sponge mop with an angle-adjustable handle. The patent also discloses an auxiliary cleaning tool and the method by which it is attached as best illustrated in FIG. 7. Referring to Column 6, the patent states "The illustrated embodiment of the present invention also includes means for selectively mounting an auxiliary cleaning tool 70, such as a scourer or a squeegee, on the front of the body portion 40 of the swivel housing 34. As illustrated in FIGS. 4 and 7, the auxiliary cleaning too 70 is mounted by a mounting plate 72 provided on the auxiliary cleaning tool 70 that is slidably lockable in a complementary key structure 74 formed in the front of the body portion 40."

Going to line 51, the Oretti Patent states "The key structure 74 is advantageously molded of a plastic material such as polypropylene or polyethylene and may be designed and configured to positively permanently snap-fit to the body portion 40 of the swivel housing 34." Also, referring to Column 7 and in particular, FIG. 8, the patent states "The forward edge of the cover 624 is provided with a key structure 626 for securing a tool mounting plate 550. The tool mounting plate has integral slide elements 552, 554 and 556 which cooperate with the key structure 626 to secure the mounting plate to the front of the pivot mop assembly."

The Slany Patent is a design patent that has a scrubber attached to the mop shaft.

The WO 01/03566 A1 Patent, this is the same as the United States Patent to Petner discussed as the Reissue Patent with the scrubber on the self wringing mop.

Most of the prior art designs deal with a mop having a plastic head so that the attachment mechanism to retain a scrubber brush can be molded into the mop head. This is not possible with a butterfly mop which has a metal head. There is a significant need for an improved attachment mechanism to removably and securely retain a cleaning implement such as a scrubber pad or scrub brush on a butterfly sponge mop which has a fixed metal housing positioned above the metal head which holds the cleaning sponge, and not a mop with a plastic head.

SUMMARY OF THE INVENTION

The present invention is a cleaning implement such as a scrubber brush attachment which permanently holds the scrubber brush attachment in place on a metal butterfly sponge mop head and will not fall off during the vigorous scrubbing action because it is locked in place by means of a novel attaching mechanism. The present invention is comprised of a molded plastic attaching mechanism which has a body having a generally flat plate which at one end is molded to a brush head which receives the scrubbing bristles of the brush. The metal butterfly mop head is modified so that at the front of the fixed metal housing of the metal mop head, there is formed a central receiving opening. The attaching mechanism has a corresponding tooth to be received into the opening. On its rear end, the fixed metal housing of the metal mop head has been modified with another central opening formed therein. The attaching mechanism has a corresponding rear tooth to be received within the rear opening of the fixed metal housing of the metal mop head. In this way, once the corresponding teeth are locking into the corresponding openings, the molded attaching mechanism is firmly locked onto the fixed metal housing of the metal mop head so the scrubber brush is firmly locked onto the fixed metal housing of the metal mop head.

Described more generally, the present invention is a cleaning implement such as a scrubber brush attachment which permanently holds the scrubber brush attachment in place on a metal butterfly sponge mop head and will not fall off during the vigorous scrubbing action because it is locked in place by means of a novel attaching mechanism. The present invention is comprised of a molded plastic attaching mechanism which has a body having a generally flat plate which at one end is molded to a brush head which receives the scrubbing bristles of the brush. The fixed metal housing of the metal butterfly mop head is modified so that the front and rear of the fixed metal housing of the mop head have mating openings which receive corresponding teeth formed into the plastic attaching mechanism.

It has been discovered, according to the present invention, that if a butterfly mop has a metal head, then it is not possible to mold an attaching mechanism to retain a scrubber brush onto the metal head and it is necessary to have a separate molded attaching mechanism made of moldable material such as plastic, rubber, polyurethane, etc. which has a brush head to receive bristles of the scrubber brush molded into the attaching mechanism and attaching means molded into the attaching mechanism by which it is attached into formed receiving means in the fixed metal housing of the metal mop head.

It has further been discovered, according to the present invention, that if the fixed metal housing of the metal mop head has a front opening and a rear opening, then if the flexible attaching mechanism has mating teeth formed into the front and rear of the attaching mechanism which are respectively received in a corresponding opening in the fixed metal housing of the metal mop head, then the attaching mechanism can be permanently locked in place on the fixed metal housing of the metal mop head and will not come loose during vigorous brushing with the attached scrubber brush.

It is therefore an object of the present invention to provide a cleaning implement such as a scrubber brush attachment which permanently holds the scrubber brush attachment in place on a metal butterfly mop head and will not fall off during the vigorous scrubbing action because it is locked in place by means of a novel attaching mechanism.

It is an object of the present invention to provide a molded plastic attaching mechanism which has a generally flat plate which at one end is molded to a brush head which receives the scrubbing bristles of the brush. The fixed metal housing of the metal butterfly mop head is modified so that the front and rear of the fixed metal housing of the mop head have mating openings which receive corresponding teeth formed into the attaching mechanism.

It is another object of the present invention to provide an attachment mechanism which has incorporated thereto a scrubber brush which attachment mechanism can be attached to the fixed metal housing of a metal mop head of a butterfly sponge mop.

It is a further object of the present invention to provide an attaching mechanism which has a brush head to receive bristles of the scrubber brush molded into the attaching mechanism and attaching means molded into the attaching mechanism by which it is attached into formed receiving means in the fixed metal housing of the metal mop head.

It is an additional object of the present invention to provide a metal mop head having a fixed metal housing with a front opening and a rear opening, so that mating teeth formed into the front and rear of the plastic attaching mechanism can be respectively received in a corresponding opening in the fixed metal housing of the metal mop head, so that the attaching mechanism can be permanently locked in place on the metal mop head and will not come loose during vigorous brushing with the attached scrubber brush.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
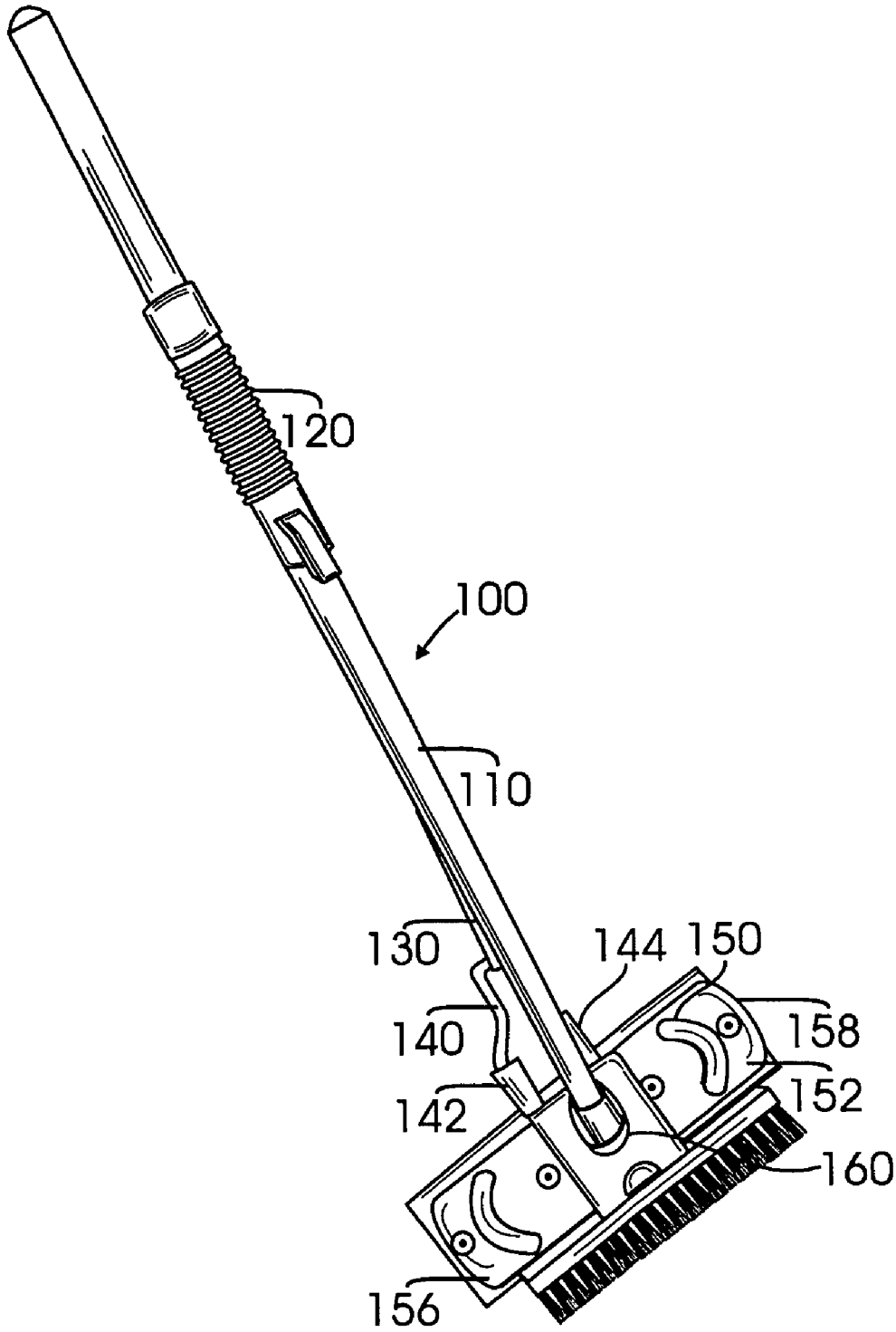
FIG. 1 is a perspective view of a butterfly sponge mop with a metal mop head with the present invention scrubber brush attachment in place.
Figure 2:
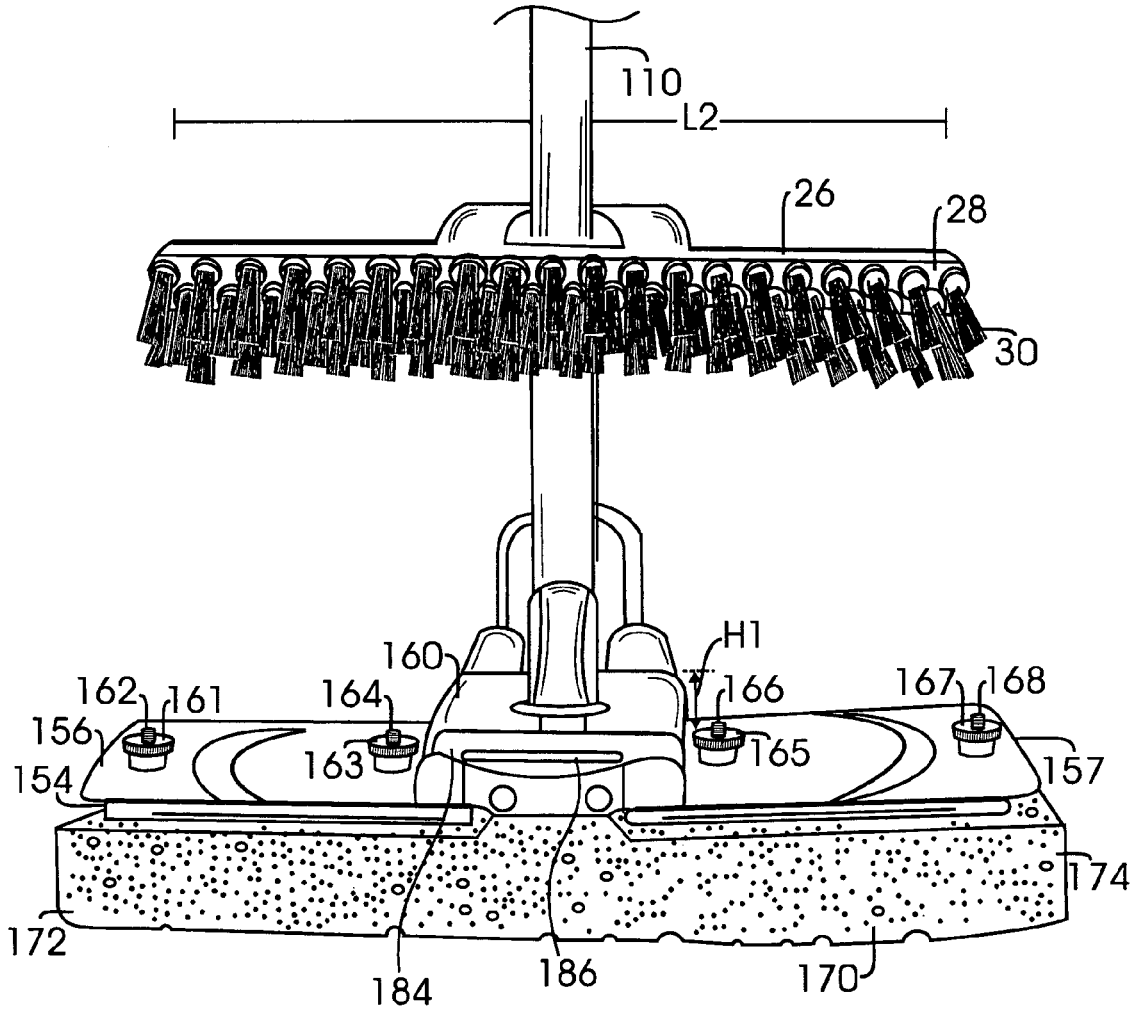
FIG. 2 is an exploded view when viewed from the front showing the attaching mechanism and the scrubber brush unattached and showing the front receiving opening in the fixed metal housing of the metal mop head.
Figure 3:
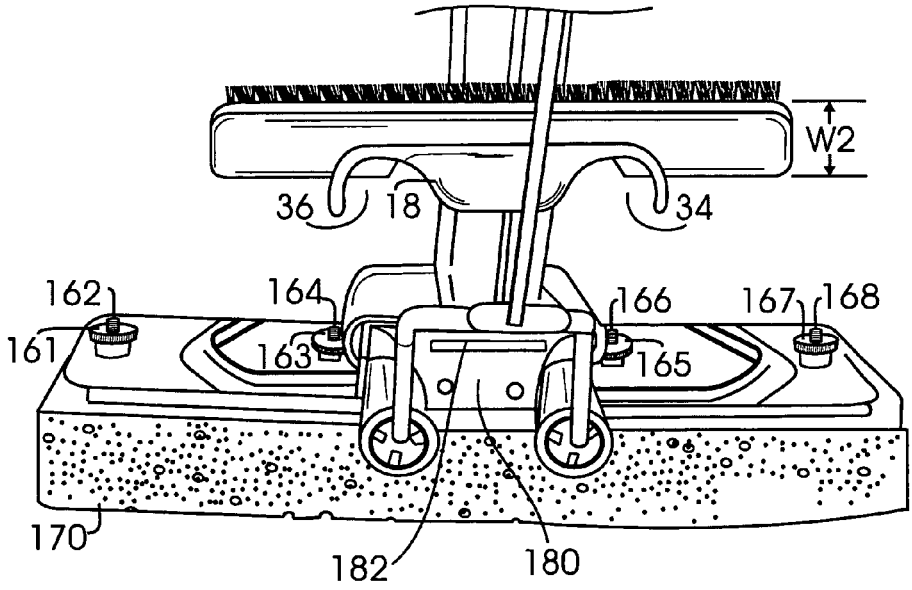
FIG. 3 is an exploded view when viewed from the rear showing the attaching mechanism and scrubber brush unattached and showing the rear receiving opening in the fixed metal housing
Figure 4:
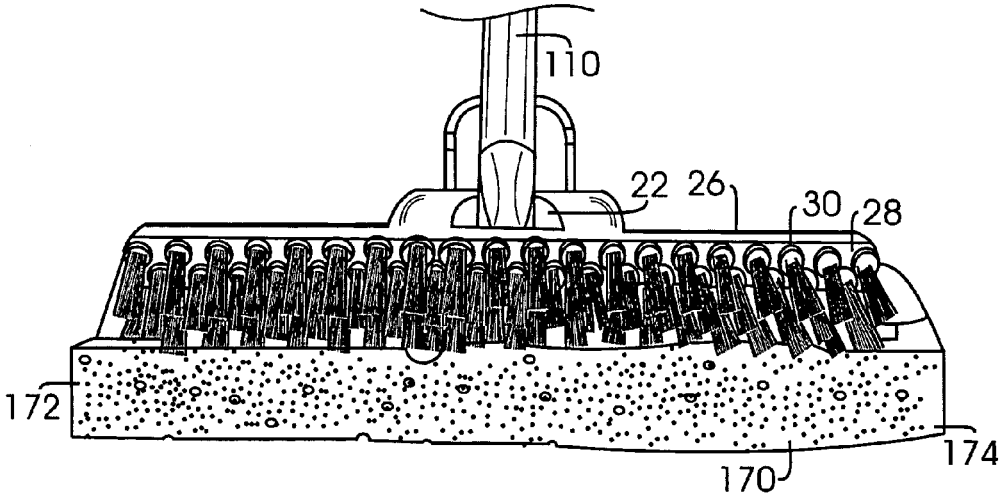
FIG. 4 is a front elevational view of the butterfly sponge mop with the attaching mechanism and scrubber brush in the attached position.

Referring to FIGS. 1 through 3, there is illustrated at 100 a butterfly sponge mop which has shaft 110 onto which is positioned a slidable handle 120 connected to a connecting rod 130 which in turn is connected to a butterfly mechanism 140 which is positioned above a metal plate 150. The butterfly mechanism 140 has two butterfly operating members 142 and 144. A metal housing 160 is fixed to the bottom of shaft 110 and rests above the top 152 of metal plate 150 and rotatably supports metal plate 150. The fixed metal housing 160 has a rear wall 180 and a front wall 184. The fixed metal housing 160 receives and rotatably supports the butterfly mechanism 140. A cleaning sponge 170 is attached to the bottom 154 of metal plate 150 by a multiplicity of sponge attaching members such as threaded sponge connecting bolts 162, 164, 166 and 168 and respective threaded locking nuts 161, 163, 165 and 167. When the slidable handle 120 is moved downwardly on shaft 110, the butterfly mechanism 140 which is rotatably supported by the fixed metal housing 160 and the metal plate which is also rotatably supported by the fixed metal housing 160 causes both sides 156 and 157 of metal plate 150 to rotate downwardly away from fixed metal housing 160 so that side sections 172 and 174 of the cleaning sponge 170 are squeezed together to drain water and dirt from the cleaning sponge 170. When the slidable handle 120 is returned to its normal position, the metal plate 150 and sponge 170 rotate back to their normal position. This paragraph describes the normal operation of a conventional butterfly sponge mop 100 having a rotatable metal plate 150 which supports the sponge 170 and a fixed metal housing 160 attached to the shaft 110 of the butterfly sponge mop 100.

Because of the nature of the metal mop head including the fixed metal housing 160 and metal plate 150, and the metal plate's rotating motion to enable water to be squeezed from the sponge 170 as described above, it is extremely difficult to mold a scrubber brush onto the fixed metal mop head 160 or onto the metal plate 150. The present invention addresses this problem through a novel molded attaching mechanism which is locked into place into the fixed metal mop head 160 in a manner that will not hinder the metal plate 150 from being rotated to squeeze water from the sponge 170.

Figure 5:
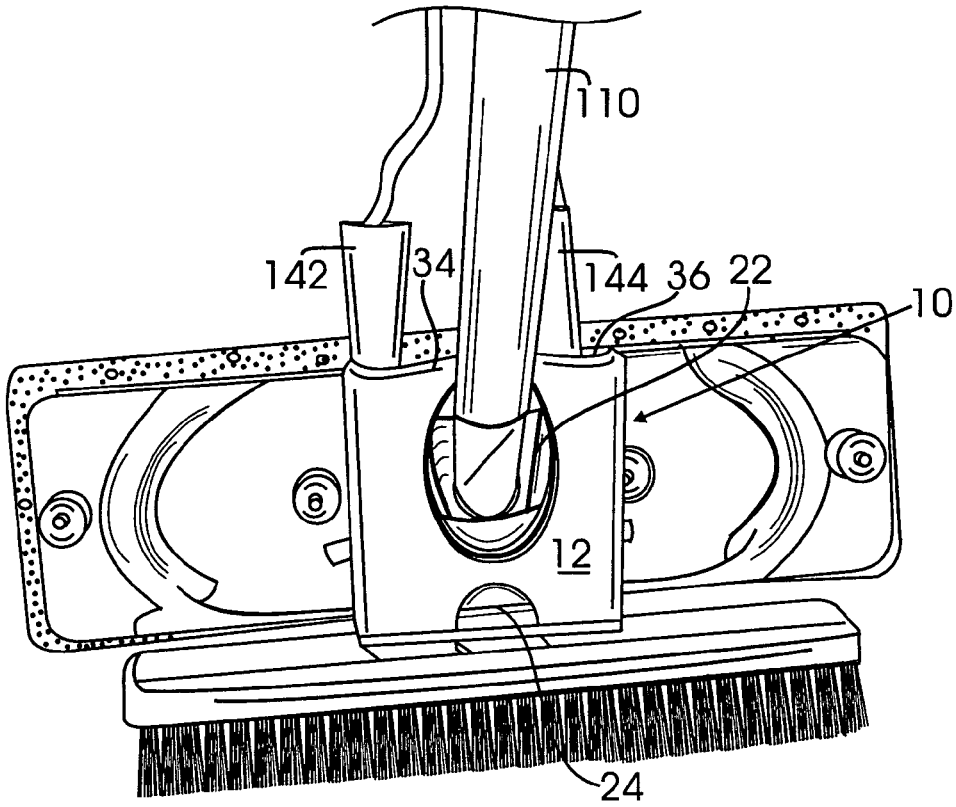
FIG. 5 is a top plan view of the attaching mechanism and scrubber brush attached to the butterfly sponge mop with a metal head.
Figure 6:
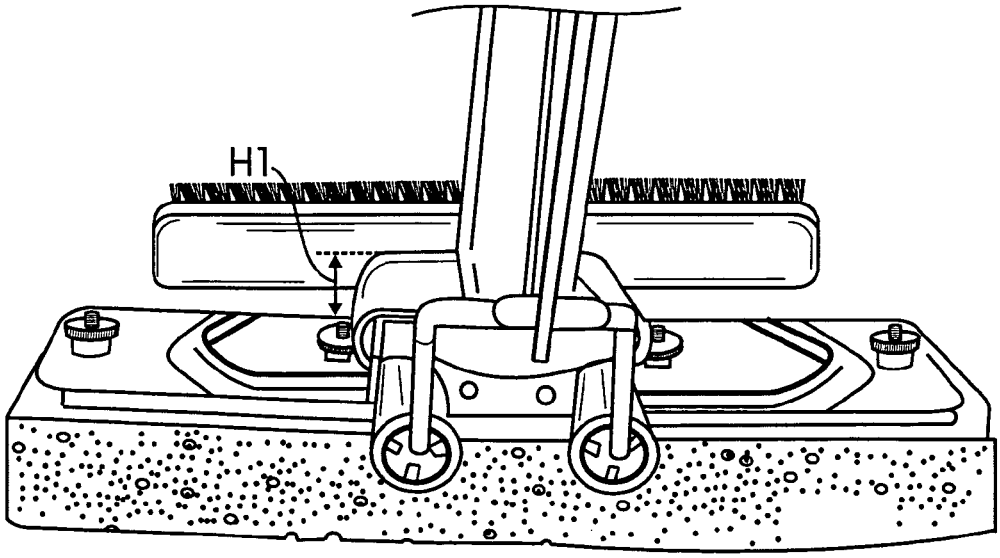
FIG. 6 is a rear elevational view of the attaching mechanism with the scrubber brush attached to the fixed metal housing of the metal mop head of the butterfly sponge mop.
Figure 7:
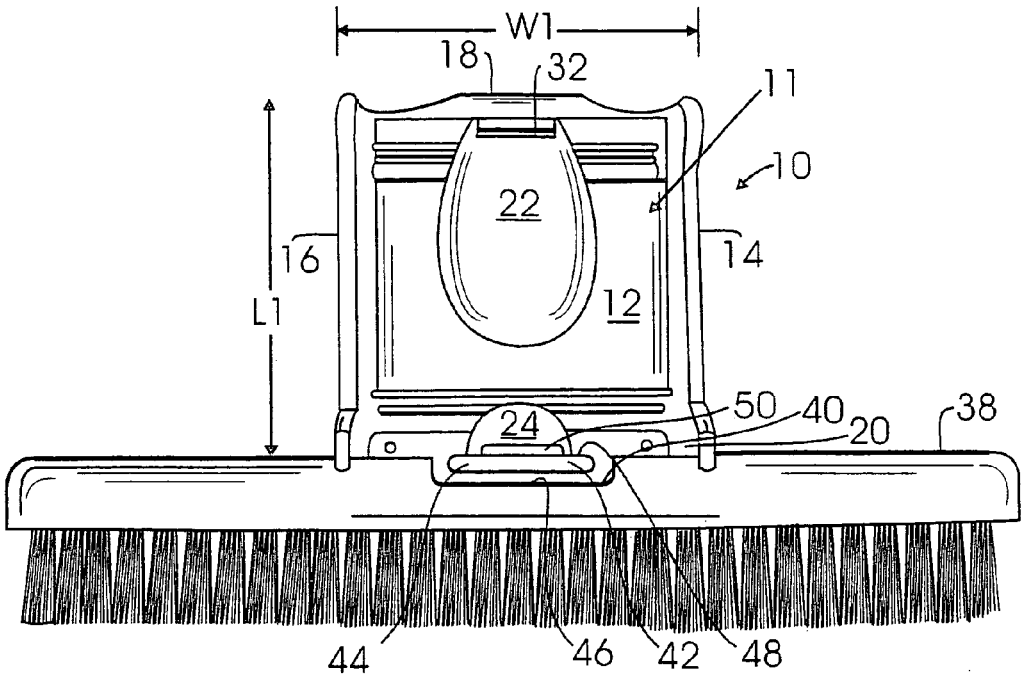
FIG. 7 is a bottom plan view of the attaching mechanism with scrubber brush, showing the front and rear teeth on the attaching mechanism.
Figure 8:
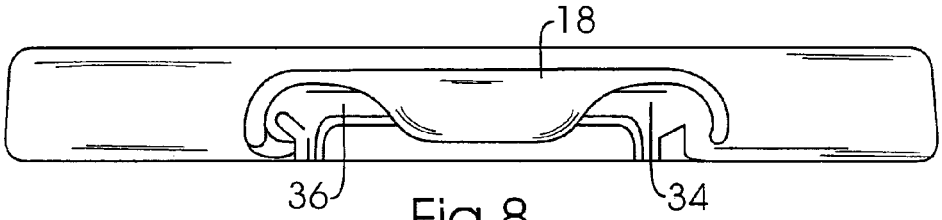
FIG. 8 is a rear plan view of the attaching mechanism.
Figure 9:
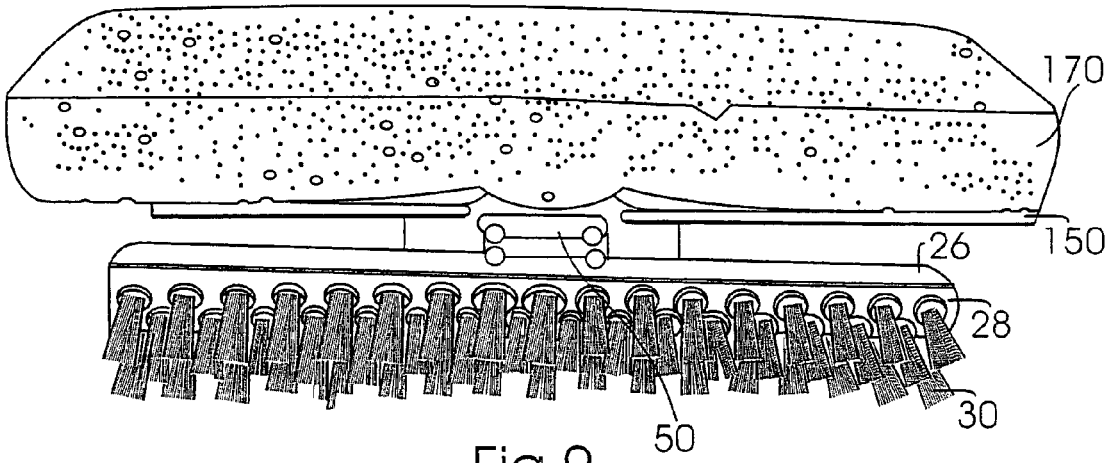
FIG. 9 is an upside down front view showing the attaching mechanism and the scrubber brush attached to the fixed metal housing of the metal mop head of the butterfly sponge mop.

Referring to FIGS. 5 and 7, the details of the molded attachment mechanism 10 of the present invention are illustrated. The molded attachment mechanism 10 has a body 11 having a generally flat top surface 12 having a length L1 and a width W1, a left sidewall 14, a right sidewall 16, a rear surface 18 and a front wall 20. The top surface 12 has an extended main opening 22 which is located adjacent the rear surface 14 and extends about two-thirds of the lengthwise distance L1 of the top surface 12. There is a small opening 24 in the top surface 12 positioned adjacent front wall 20. Molded into front wall 20 and integral with the front wall 20 so that the entire molded attachment mechanism is one piece is a brush head 26. The brush head 26 is molded so that its length L2 extend transversely to front wall 20 as illustrated. Brush head 26 also has a width W2 which is greater than the height H1 of the body 11 of the molded attachment mechanism 10. A multiplicity of bristles 30 are supported on the front surface 28 of brush head 26.

A rear tooth 32 is molded into molded attaching mechanism 10. The rear tooth 32 extends into the area immediately below extended main opening 22 from a centrally disposed location on the interior 32 of rear wall 18. Rear wall 18 also has a pair of oppositely disposed arcuate openings 34 and 36 to respectively accommodate the butterfly mechanism operating member 142 and 144. As best illustrated in the bottom view of FIG. 7, the brush head 26 has a bottom surface 38 into which is formed a transverse channel 40. An interior wall 42 is formed into the transverse channel 40 so that a gap or slot 44 is formed between brush facing surface 46 of interior wall 42 and the interior wall 48 of transverse channel 40. A front tooth 50 is formed into the rearward facing wall 42 of transverse channel 40, which front tooth extends rearwardly below the area of small opening 24.

Referring to FIG. 3, there is formed into rear wall 180 of fixed metal housing 160 a centrally disposed elongated opening 182 which is designed to receive and retain rear tooth 32 of molded attachment mechanism 10. Referring to FIG. 2, there is formed into front wall 184 of fixed metal housing 160 a centrally disposed elongated opening 186.

In operation, the molded attachment mechanism 10 is placed onto the butterfly sponge mop 100 so that the extended main opening 22 is positioned over shaft 110 so that the molded attachment mechanism 10 rests at the bottom of shaft 110 and over fixed metal housing 160. This must be accomplished before the slidable handle 120 is affixed to connecting rod 130. The rear tooth 32 is pushed or snapped into elongated opening 182 and the front tooth 50 is then placed or snapped into front elongated opening 186. The gap or slot 44 enables the interior wall 42 to be flexible so that the front tooth 50 can be snapped into elongated opening 186 after rear tooth 32 has been placed into rear elongated opening 182. The molded attaching mechanism just fits over the fixed metal wall 160 and the arcuate openings 34 and 36 respectively accommodate a butterfly operating member 142 and 146 so that the snap fit causes the molded attaching member 10 to remain fixed onto and into the fixed metal housing.

When the butterfly sponge mop is used to clean tough ingrained dirt, the bristles 30 are scrubbed against the ingrained dirt with a vigorous action. The strength of the attachment of the molded attachment mechanism 10 to the fixed metal housing 160 prevents the scrubber (brush head 26 and bristles 30) from coming loose. When it is desired to wring water from the sponge 170, the slidable handle 120 is moved downwardly on shaft 110 which causes the left side 154 and right side 156 of the metal plate 160 and first side 172 and second side 174 of sponge 170 to rotated against each other to squeeze water from the sponge 170. The fixed metal housing 160 and molded attachment mechanism 10 remain stationary during this water squeezing process.

The molded attachment mechanism 10 and its components (except the bristles 30) are molded as a single piece and can be molded out of any strength flexible material such as plastic, rubber, polyurethane. etc.

While the present invention attachment 10 was illustrated with a cleaning brush, it will be appreciated that a scrubber pad or any other type of cleaning implement can be affixed to the front of surface 28 of brush head 26 so that the novel attaching mechanism can support any cleaning implement.

Defined in detail, the present invention is a butterfly sponge mop having a shaft with a fixed metal housing having a top surface affixed to the base of the shaft and having a front wall and a rear wall, the shaft including a slidable handle affixed to a rod which in turn is affixed to a pair of butterfly operating members rotatably supported on the fixed metal housing and a metal plate rotatably supported on the fixed metal housing and in turn supporting a sponge, the improvement comprising: (a) a molded attachment mechanism with a body having a top surface of a given length, a left sidewall, a right sidewall, a rear wall and a front wall, the top surface having an extended opening located adjacent the rear wall and extending for approximately two thirds of the length of the top surface, and a small opening in the top surface located adjacent the front wall; (b) a brush head extending transversely to and molded onto the front wall of the body so that it is integral therewith, the brush head supporting a multiplicity of bristles on its front wall; (c) a rear tooth molded into the central area of the rear wall of the body and extending into the area immediately below the extended main opening; (d) the rear wall having a pair of oppositely disposed arcuate openings to respectively accommodate a respective butterfly operating member; (e) the brush head having a bottom surface into which is formed a transverse channel, an interior wall formed into the transverse channel so that a gap is formed between an interior surface of the interior wall and an interior wall of the channel, a front tooth formed into the interior wall and extending away from the brush head and also located beneath the small opening in the top surface of the body; (f) a central opening formed into the front wall of the fixed metal housing and a central opening formed into the rear wall of the fixed metal housing; and (g) the molded attachment mechanism positioned so that the main opening in the top surface surrounds the mop shaft, the rear tooth fits into and is retained in the central opening in the rear of the fixed metal housing and the front tooth snaps into and is retained in the central opening in the front wall of the fixed metal housing, the body of the molded attachment mechanism lies against the top of the fixed metal housing so that the molded attachment mechanism remains stationary when the butterfly mechanism is activated to wring water from the sponge and the molded attachment mechanism is firmly attached so that it will not come loose during vigorous scrubbing action with the brush.

Defined broadly, the present invention is a butterfly sponge mop having a shaft with a fixed housing having a top surface affixed to the base of the shaft and having a front wall and a rear wall, the shaft including a slidable handle affixed to a rod which in turn is affixed to a pair of butterfly operating members rotatably supported on the fixed housing and a plate rotatably supported on the fixed housing and in turn supporting a sponge, the improvement comprising: (a) an attachment mechanism with a body having a top surface of a given length, a left sidewall, a right sidewall, a rear wall and a front surface, the top surface having an extended opening located adjacent the rear wall and extending for a distance into the top surface, and a small opening in the top surface located adjacent the front surface; (b) a cleaning implement head extending transversely to and molded onto the front surface of the body so that it is integral therewith, the cleaning implement head supporting a cleaning implement on its front wall; (c) a rear tooth molded into the central area of the rear wall of the body and extending into the area immediately below the extended main opening; (d) the rear wall having a pair of oppositely disposed arcuate openings to respectively accommodate a respective butterfly operating member; (e) the cleaning implement head having a bottom surface into which is formed a transverse channel, an interior wall formed into the transverse channel so that a gap is formed between an interior surface of the interior wall and an interior wall of the channel, a front tooth formed into the interior wall and extending away from the cleaning implement head and also located beneath the small opening in the top surface of the body; (f) a central opening formed into the front wall of the fixed housing and a central opening formed into the rear wall of the fixed housing; and (g) the attachment mechanism positioned so that the main opening in the top surface surrounds the mop shaft, the rear tooth fits into and is retained in the central opening in the rear wall of the fixed housing and the front tooth snaps into and is retained in the central opening in the front wall of the fixed housing, the body of the attachment mechanism lies against the top of the fixed housing so that the attachment mechanism remains stationary when the butterfly mechanism is activated to wring water from the sponge and the attachment mechanism is firmly attached so that it will not come loose during vigorous scrubbing action with the cleaning implement.

Defined even more broadly, the present invention is a butterfly sponge mop having a shaft with a fixed housing having a top surface affixed to the base of the shaft and having a front wall and a rear wall, a butterfly mechanism and a sponge, the improvement comprising: (a) an attachment mechanism with a body having a top surface, a rear wall and a front surface, the top surface having an opening; (b) a cleaning implement head extending transversely to and molded onto the front surface of the body so that it is integral therewith, the cleaning implement head supporting a cleaning implement on its front wall; (c) a rear tooth molded into the rear wall of the body and extending toward the cleaning implement head; (d) the cleaning implement head having a bottom surface into which is formed a transverse channel, an interior wall formed into the transverse channel, a front tooth formed into the interior wall and extending away from the cleaning implement head; (e) an opening formed into the front wall of the fixed housing and an opening formed into the rear wall of the fixed housing; and (f) the attachment mechanism positioned so that the opening in the top surface surrounds the mop shaft, the rear tooth fits into and is retained in the opening in the rear wall of the fixed housing and the front tooth fits into and is retained in the opening in the front wall of the fixed housing, the body of the attachment mechanism lies against the top of the fixed housing so that the attachment mechanism remains stationary when the butterfly mechanism is activated to wring water from the sponge and the attachment mechanism is firmly attached so that it will not come loose during vigorous scrubbing action with the cleaning implement.

Defined even more broadly, the present invention is a butterfly sponge mop having a shaft with a fixed housing having a top surface affixed to the base of the shaft and having a front wall and a rear wall, the improvement comprising: (a) an attachment mechanism with a body having a top surface, a rear wall and a front surface, the top surface having an opening; (b) a cleaning implement head extending transversely to and molded onto the front surface of the body so that it is integral therewith, the cleaning implement head supporting a cleaning implement on its front wall; (c) a rear tooth molded into the rear wall of the body and extending toward the cleaning implement head; (d) the cleaning implement head having a means formed therein to retain a formed front tooth extending toward the rear tooth; (e) an opening in the front wall of the fixed housing and an opening in the rear wall of the fixed housing; and (f) the attachment mechanism positioned so that the opening in the top surface surrounds the mop shaft, the rear tooth fits into and is retained in the opening in the rear wall of the fixed housing and the front tooth fits into and is retained in the opening in the front wall of the fixed housing, so that the attachment mechanism is firmly attached so that it will not come loose during vigorous scrubbing action with the cleaning implement.

Defined even more broadly, the present invention is a butterfly sponge mop having a shaft with a fixed housing having a top surface affixed to the base of the shaft and having a front wall and a rear wall, the improvement comprising: (a) an attachment mechanism with a body having a top surface, a rear wall and a front surface, the top surface having an opening; (b) a cleaning implement head extending transversely to and molded onto the body so that it is integral therewith, the cleaning implement head supporting a cleaning implement on its front wall; (c) a rear attaching means formed into the rear wall of the body and extending toward the cleaning implement head; (d) the cleaning implement head having a means formed therein to retain a formed front attaching means extending toward the rear attaching means; (e) a receiving means in the front wall of the fixed housing and a receiving means in the rear wall of the fixed housing; and (f) the attachment mechanism positioned so that the opening in the top surface surrounds the mop shaft, the rear attaching means is retained in the receiving means in the rear wall of the fixed housing and the front attaching means is retained in the receiving means in the front wall of the fixed housing, so that the attachment mechanism is firmly attached so that it will not come loose during vigorous scrubbing action with the cleaning implement.

Defined most broadly, the present invention is a butterfly sponge mop having a fixed housing having a front wall and a rear wall, the improvement comprising: (a) an attachment mechanism with a body having a rear wall and a front surface; (b) a cleaning implement head extending transversely to and molded onto the body so that it is integral therewith, the cleaning implement head supporting a cleaning implement on its front wall; (c) a rear attaching means formed into the rear wall of the body and extending toward the cleaning implement head; (d) the cleaning implement head having a means formed therein to retain a formed front attaching means extending toward the rear attaching means; (e) a receiving means in the front wall of the fixed housing and a receiving means in the rear wall of the fixed housing; and (f) the attachment mechanism positioned so that the rear attaching means is retained in the receiving means in the rear wall of the fixed housing and the front attaching means is retained in the receiving means in the front wall of the fixed housing, so that the attachment mechanism is firmly attached so that it will not come loose during vigorous scrubbing action with the cleaning implement.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. In a butterfly sponge mop having a shaft with a fixed housing having a top surface affixed to the base of the shaft and having a front wall and a rear wall, the improvement comprising:

a. an attachment mechanism with a body having a top surface, a rear wall and a front surface, the top surface having an opening;

b. a cleaning implement head extending transversely to and molded onto the front surface of the body so that it is integral therewith, the cleaning implement head supporting a cleaning implement on its front wall;

c. a rear tooth molded into the rear wall of the body and extending toward the cleaning implement head;

d. the cleaning implement head having a means formed therein to retain a formed front tooth extending toward the rear tooth;

e. an opening in the front wall of the fixed housing and an opening in the rear wall of the fixed housing; and f. the attachment mechanism positioned so that the opening in the top surface of the attachment mechanism surrounds the mop shaft, the rear tooth fits into and is retained in the opening in the rear wall of the fixed housing and the front tooth fits into and is retained in the opening in the front wall of the fixed housing, so that the attachment mechanism is firmly attached so that it will not come loose during vigorous scrubbing action with the cleaning implement.

2. The improvement to a butterfly sponge mop in accordance with claim 1, wherein the attachment mechanism including the body, the cleaning implement head, the front tooth, and the rear tooth are all formed from a single piece of material selected from the group comprising plastic, rubber and polyurethane.

3. The improvement to a butterfly sponge mop in accordance with claim 1 wherein the cleaning implement head is a brush head and the cleaning implement is a multiplicity of bristles.

4. In a butterfly sponge mop having a shaft with a fixed housing having a top surface affixed to the base of the shaft and having a front wall and a rear wall, a butterfly mechanism and a sponge, the improvement comprising:

a. an attachment mechanism with a body having a top surface, a rear wall and a front surface, the top surface having an opening;

b. a cleaning implement head extending transversely to and molded onto the front surface of the body so that it is integral therewith, the cleaning implement head supporting a cleaning implement on its front wall;

c. a rear tooth molded into the rear wall of the body and extending toward the cleaning implement head;

d. the cleaning implement head having a bottom surface into which is formed a transverse channel, an interior wall formed into the transverse channel, a front tooth formed into the interior wall and extending away from the cleaning implement head;

e. an opening formed into the front wall of the fixed housing and an opening formed into the rear wall of the fixed housing; and f. the attachment mechanism positioned so that the opening in the top surface of the attachment mechanism surrounds the mop shaft, the rear tooth fits into and is retained in the opening in the rear wall of the fixed housing and the front tooth fits into and is retained in the opening in the front wall of the fixed housing, the body of the attachment mechanism lies against the top of the fixed housing so that the attachment mechanism remains stationary when the butterfly mechanism is activated to wring water from the sponge and the attachment mechanism is firmly attached so that it will not come loose during vigorous scrubbing action with the cleaning implement.

5. The improvement to a butterfly sponge mop in accordance with claim 4, wherein the attachment mechanism including the body, the cleaning implement head, the front tooth, the rear tooth and the interior wall are all formed from a single piece of material selected from the group comprising plastic, rubber and polyurethane.

6. The improvement to a butterfly sponge mop in accordance with claim 4 wherein the cleaning implement head is a brush head and the cleaning implement is a multiplicity of bristles.

7. In a butterfly sponge mop having a shaft with a fixed housing having a top surface affixed to the base of the shaft and having a front wall and a rear wall, the shaft including a slidable handle affixed to a rod which in turn is affixed to a pair of butterfly operating members rotatably supported on the fixed housing and a plate rotatably supported on the fixed housing and in turn supporting a sponge, the improvement comprising:

a. an attachment mechanism with a body having a top surface of a given length, a left sidewall, a right sidewall, a rear wall and a front surface, the top surface having an extended main opening located adjacent the rear wall and extending for a distance into the top surface, and a small opening in the top surface located adjacent the front surface;

b. a cleaning implement head extending transversely to and molded onto the front surface of the body so that it is integral therewith, the cleaning implement head supporting a cleaning implement on its front wall;

c. a rear tooth molded into the central area of the rear wall of the body and extending into the area immediately below the extended main opening;

d. the rear wall having a pair of oppositely disposed arcuate openings to respectively accommodate a respective butterfly operating member;

e. the cleaning implement head having a bottom surface into which is formed a transverse channel, an interior wall formed into the transverse channel so that a gap is formed between an interior surface of the interior wall and an interior wall of the channel, a front tooth formed into the interior wall and extending away from the cleaning implement head and also located beneath the small opening in the top surface of the body;

f. a central opening formed into the front wall of the fixed housing and a central opening formed into the rear wall of the fixed housing; and g. the attachment mechanism positioned so that the extended main opening in the top surface of the attachment mechanism surrounds the mop shaft, the rear tooth fits into and is retained in the central opening in the rear wall of the fixed housing and the front tooth snaps into and is retained in the central opening in the front wall of the fixed housing, the body of the attachment mechanism lies against the top of the fixed housing so that the attachment mechanism remains stationary when the butterfly mechanism is activated to wring water from the sponge and the attachment mechanism is firmly attached so that it will not come loose during vigorous scrubbing action with the cleaning implement.

8. The improvement to a butterfly sponge mop in accordance with claim 7, wherein the attachment mechanism including the body, the cleaning implement head, the front tooth, the rear tooth and the interior wall are all formed from a single piece of material selected from the group comprising plastic, rubber and polyurethane.

9. The improvement to a butterfly sponge mop in accordance with claim 7 wherein the cleaning implement head is a brush head and the cleaning implement is a multiplicity of bristles.

10. In a butterfly sponge mop having a shaft with a fixed metal housing having a top surface affixed to the base of the shaft and having a front wall and a rear wall, the shaft including a slidable handle affixed to a rod which in turn is affixed to a pair of butterfly operating members rotatably supported on the fixed metal housing and a metal plate rotatably supported on the fixed metal housing and in turn supporting a sponge, the improvement comprising:

a. a molded attachment mechanism with a body having a top surface of a given length, a left sidewall, a right sidewall, a rear wall and a front wall, the top surface having an extended main opening located adjacent the rear wall and extending for approximately two thirds of the length of the top surface, and a small opening in the top surface located adjacent the front wall;

b. a brush head extending transversely to and molded onto the front wall of the body so that it is integral therewith, the brush head supporting a multiplicity of bristles on its front wall;

c. a rear tooth molded into the central area of the rear wall of the body and extending into the area immediately below the extended main opening;

d. the rear wall having a pair of oppositely disposed arcuate openings to respectively accommodate a respective butterfly operating member;

e. the brush head having a bottom surface into which is formed a transverse channel, an interior wall formed into the transverse channel so that a gap is formed between an interior surface of the interior wall and an interior wall of the channel, a front tooth formed into the interior wall and extending away from the brush head and also located beneath the small opening in the top surface of the body;

f. a central opening formed into the front wall of the fixed metal housing and a central opening formed into the rear wall of the fixed metal housing; and g. the molded attachment mechanism positioned so that the extended main opening in the top surface of the molded attachment mechanism surrounds the mop shaft, the rear tooth fits into and is retained in the central opening in the rear of the fixed metal housing and the front tooth snaps into and is retained in the central opening in the front wall of the fixed metal housing, the body of the molded attachment mechanism lies against the top of the fixed metal housing so that the molded attachment mechanism remains stationary when the butterfly mechanism is activated to wring water from the sponge and the molded attachment mechanism is firmly attached so that it will not come loose during vigorous scrubbing action with the brush.

11. The improvement to a butterfly sponge mop in accordance with claim 10, wherein the molded attachment mechanism including the body, the brush head, the front tooth, the rear tooth and the interior wall are all formed from a single piece of material selected from the group comprising plastic, rubber and polyurethane.

* * * * *